United States Patent [19]

Renschen

[11] 3,972,712

[45] Aug. 3, 1976

[54] COPPER BASE ALLOYS

[75] Inventor: Patrick D. Renschen, Mentor, Ohio

[73] Assignee: Brush Wellman, Inc., Cleveland, Ohio

[22] Filed: Feb. 27, 1975

[21] Appl. No.: 553,485

Related U.S. Application Data

[63] Continuation of Ser. No. 474,318, May 29, 1974, abandoned.

[52] U.S. Cl. ..... 75/157.5; 75/153; 148/32.5; 148/160

[51] Int. Cl.[2] ..... C22C 9/04

[58] Field of Search ..... 75/153, 157.5; 148/32.5, 160

[56] References Cited

UNITED STATES PATENTS

| | | | |
|---|---|---|---|
| 2,408,341 | 9/1946 | Rodda | 75/157.5 |
| 2,408,342 | 9/1946 | Rodda | 75/157.5 |
| 3,166,410 | 1/1965 | Hanson et al. | 75/153 |

FOREIGN PATENTS OR APPLICATIONS

| | | | |
|---|---|---|---|
| 380,570 | 9/1932 | United Kingdom | 148/160 |
| 954,288 | 4/1964 | United Kingdom | 75/157.5 |

*Primary Examiner*—Walter R. Satterfield
*Attorney, Agent, or Firm*—McNenny, Pearne, Gordon, Gail, Dickinson & Schiller

[57] ABSTRACT

Copper-base alloys are disclosed which are characterized by unusually low melting points combined with good tensile strength and ductility in the as-cast condition, excellent founding characteristics, high hardness and strength in the as-cast plus heat treated condition, ability to be used as brazing alloys, and excellent wrought characteristics. These alloys can possess an attractive pale gold or silvery appearance as cast in sand, permanent mold and investment mold, and comprise the following constituents in the ranges and ratios specified:

| | Percent by Weight |
|---|---|
| Manganese | 12 to 36 |
| Zinc | 4 to 28 |
| Beryllium | 0.10 to 1.00 |
| Copper | 50.0 + (10 × Be content) to 58.0 + (14 × Be content). |

Up to 2% lead may be usefully incorporated in these alloys to improve machinability.

14 Claims, 13 Drawing Figures

COPPER BASE ALLOYS

This application is a continuation of my copending application Ser. No. 474,318, filed May 29, 1974 and now abandoned.

PRIOR ART

U.S. Pat. No. 2,408,342 — 1946 — Rodda
U.S. Pat. No. 3,318,693 — 1967 — Foerster et al.
U.S. Pat. No. 3,764,306 — 1973 — Blythe et al.
Canadian Pat. No. 845,633 — 1970.

BACKGROUND OF THE INVENTION

Although copper-base alloys generally possess higher strength and corrosion resistance than aluminum and zinc-base alloys, they are not pressure die cast to the same degree because their higher melting points (generally over 1600°F.) cause shorter steel die life or require the use of more expensive die materials. It is generally felt that lower melting point copper-base alloys should improve die life and could therefore use to advantage the high volume, relatively low cost pressure die casting process. Such alloys could also be cast in sand, permanent and investment molds.

As used in the specification and claims, all composition percentages are by weight.

Alloys are known in the prior art which have melting points lower than standard copper-zinc die casting alloys. Certain alloys containing 2–6.8% phosphorus, 20–34% zinc, 0–1% lead, 0–8% nickel, balance copper, exhibit liquidus temperatures as low as 1252°F., but have low tensile ductility when chill cast. Alloys containing as much as 25% antimony and 10% magnesium melt as low as 720°C. (1328°F.) but these, too, are brittle (less than 1% tensile elongation). Alloys containing 1–1.5% aluminum, 17–22% manganese, 17–22% zinc, and 58–60.5% copper have liquidus temperatures below 1850°F., and generally in the range of 1550° – 1600°F. Thus, while copper-base alloys have been proposed which have low liquidus points, they find little commercial use because of poor mechanical properties. Conversely, those alloys which exhibit good mechanical properties have high liquidus points and wide freezing ranges, and are difficult to cast, particularly by die casting techniques.

SUMMARY OF THE INVENTION

Alloys in accordance with the present invention have liquidus temperatures at or below 1517°F., and some as low as 1481°F. Freezing ranges are generally small, providing a favorable single pipe shrinkage pattern as opposed to a more widely dispersed shrinkage porosity associated with alloys with large freezing ranges. Tensile strength and ductility are good and the alloys possess excellent fluidity and ability to replicate mold surface detail. As-cast surfaces, adjacent both to the mold and to the air, show little oxidation, being instead highly lustrous and silvery or pale gold in appearance. The alloys are readily remelted without change in composition. Alloys within the invention show definite increases in hardness and tensile strength when given a relatively low temperature ageing heat treatment after solution heat treating at a temperature just below their melting points.

Sand, permanent mold, investment mold, and pressure die castings have been successfully made from alloys within the scope of this invention. The low melting point, coupled with excellent fluidity and replication of mold detail of these alloys, allow them to be readily die cast. Longer die life than currently obtainable with existing pressure die casting compositions is expected. For the purposes of this disclosure, by pressure die casting is meant a casting process in which molten metal is forced into a permanent mold or die under applied pressure; and by permanent mold casting is meant a casting process in which molten metal is fed into a permanent mold by gravity alone.

Alloys in accordance with this invention cast in permanent molds can be hot and cold worked to plate or strip. These wrought alloys and castings of the same compositions can be heat treated to achieve high hardness and strength.

Potential applications for alloys within the scope of this invention include plumbing and architectural hardware and core tooling for plastic mold injection equipment. Good as-cast tensile strength and ductility and highly lustrous as-cast surfaces are of considerable importance in these end uses. The ability of the alloys to be strengthened by simple thermal treatments is of importance where this high strength is required to lower part weight or physical dimensions in machinery or equipment.

A small amount of lead imparts improved machinability without impairing other desirable features of these alloys. Up to 2% lead may be added, but as little as 0.5% has a noticeable effect on improving machinability. "Machinability," in its broadest context, is taken to mean the ability of the alloy to be machined by sawing, abrasive wheel cutting, drilling, turning, shaping, grinding or other machine shaping process to finish a casting to specified shape and dimensions.

Within the Cu-Mn-Zn-Be alloy system contemplated by this invention, certain characteristics normally exhibited by the system may be optimized by varying amounts and ratios of the specified ingredients. For example, minimum liquidus points may be obtained by holding the manganese-to-zinc ratio between 0.5 and 3.8, the beryllium between 0.6 and .75%, and copper between 58 and 62.5%. Mechanical properties may be optimized with manganese-to-zinc ratios of 3.5 to 10, beryllium contents of 0.6 to .75%, and copper contents of 58 to 62.5%. Castability is optimized for all of the alloys as long as the beryllium is at least 0.1%. Replication of detail is very good so long as the beryllium content is kept above 0.25%. Alloys with a manganese-to-zinc ratio of less than 1.0 tend to replicate mold wall detail better than those alloys having a manganese-to-zinc ratio greater than 1.0. However, as long as the beryllium content is kept at 0.5% or above, replication of mold wall detail is optimized. For those applications which require a bright, clean, and lustrous surface, the manganese-to-zinc ratio should be kept below 4.0. For those alloys within the system which are to be used in corrosive environments, i.e., as die-cast plumbing fixtures, the ability of the material to withstand dealloying, i.e., the selective removal of manganese and zinc from the matrix, alloys having a manganese-to-zinc ratio of about 1.2 and a low beryllium content of about 0.25% have superior dealloying resistance to those alloys within the system with higher or lower manganese-to-zinc ratios and higher beryllium contents. It is known that alloys with no beryllium have a better resistance to dealloying, but other properties noted above would be sacrificed. Therefore, beryllium should be kept as low as possible in this situation but compatible with the other characteristics of the casting alloy for the particular application involved. There are optimum alloys within the system which are very suitable for use as a brazing material. For example, an alloy containing 18.5% manganese, 21.2% zinc, and 0.32% beryllium is a better brazing material than alloys containing 24.0% manganese, 16.3% zinc, 0.25% beryllium, or an alloy containing 15.0% manganese, 24.7% zinc, and 0.29% beryllium. It may be noted that all three of these alloys have about the same total manganese and zinc contents, and therefore about the same copper content. However, the manganese-rich and zinc-rich alloys do not perform as well as an alloy containing about the same manganese and zinc. An acceptable composition range for a brazing alloy is from 18.0 to 19.0% manganese, 20.5 to 21.5% zinc, and from 0.2 to 0.35% beryllium. To optimize hot and cold workability leading to wrought materials, manganese-to-zinc ratios should be between 0.6 and 1.3, with beryllium contents not greater than about 0.4% and copper contents of not less than about 60%. Where higher manganese-to-zinc ratios are employed, i.e., 1.3, the wrought material is more ductile but has lower strength.

It should be noted in the system that where low weight percent amounts of beryllium are employed, the permissible copper range is smaller, and with high beryllium contents the permissible copper range is larger. Therefore, less preciseness and attention to the permissible copper content is needed with higher beryllium contents if those higher contents do not deleteriously affect the desired properties, i.e., principally ductility.

DETAILED DESCRIPTION OF THE INVENTION

Figure 1:
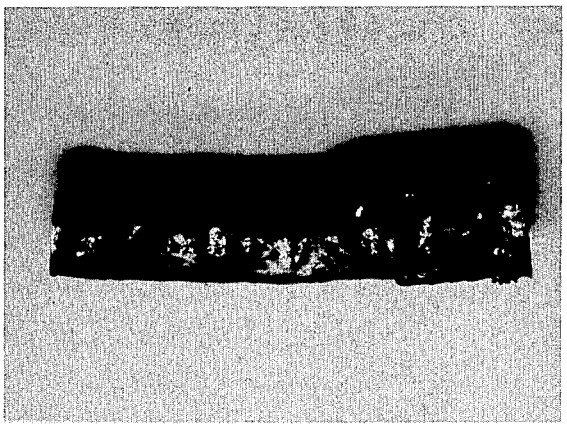
FIGS. 1 and 2 are photographic reproductions of castings outside the scope of this invention, illustrating poor mold replication.

The beryllium content of the copper-manganese-zinc-beryllium alloys of this invention must be kept within the range 0.10–1.00% to ensure low melting alloys of excellent founding characteristics and good as-cast tensile strength and ductility. Below 0.10%, the alloys have very poor founding characteristics: they form very heavy oxide skins during melting and pouring, have limited fluidity, and do not replicate mold surfaces well. Above 1.00%, relatively high liquidus temperatures and large freezing ranges are obtained, requiring higher pouring temperatures and increasing the possibility of unwanted dispersed shrinkage porosity in the casting. At 2% beryllium, low as-cast tensile strength and ductility also occur.

The copper content, dependent on beryllium content, must be kept within the range of 50.0% + (10 × Be content) to 58.0% + (14 × Be content). For example, at 0.20% beryllium, the permissible copper content is 52–60.8%, and at 0.75% beryllium, the permissible copper content is 57.5–68.5%. For alloys with copper below this range, relatively high liquidus temperature and large freezing ranges may result, or low as-cast tensile ductility may be encountered. For alloys with copper above this range, relatively high liquidus temperatures and large freezing ranges occur. According to the teachings of this invention, therefore, the broad ranges may be stated as follows: manganese, 12 to 36%; zinc, 4 to 28%; beryllium, 0.10 to 1.00%; and copper, 51 to 72%.

Generally speaking, increasing beryllium content in the range 0.10–1.00% lowers the liquidus temperature, improves the founding characteristics, enhances fluidity and ability to replicate mold surfaces, lowers ductility, and increases as-cast tensile yield strength. Decreasing copper content in the ranges defined above as a function of the beryllium content generally lowers the liquidus temperature, improves as-cast tensile strength, and lowers as-cast tensile ductility. From the arithmetic expressions defining the upper and lower limits of the copper range as dependent on beryllium content, it can be seen that the higher beryllium alloys generally require higher copper contents and the permissible copper range is broadened. That is to say that an alloy containing 0.19% beryllium, 56.81% copper, and the balance manganese and zinc (in their specified ranges) is within the scope of this invention, and an alloy containing 0.74% beryllium must contain also at least 57.40% copper, balance manganese and zinc, to assure a low liquidus temperature and good as-cast tensile ductility.

The zinc and manganese contents must be maintained in the ranges 4–28% and 12–36%, respectively. Decreasing either element below its range increases liquidus and solidus temperatures. Increasing zinc content above 28% causes excessive fuming during melting and casting, and increasing manganese content above 36% causes heavy dross to form on the molten metal bath during melting and an oxide skin to form on the molten stream during pouring.

Incidental impurities which can be present in the alloys without changing their desirable characteristics include iron, cobalt, nickel, tin, carbon, aluminum, phosphorus, silicon, arsenic, and cerium. The copper, manganese, zinc, and beryllium content of any one alloy when totaled will normally be 100%, although values as low as 97.5% may be acceptable if impurities are present.

The fact that beryllium in the range specified lowered the liquidus temperature of copper-manganese-zinc ternary alloys was surprising and unexpected. Other elements which, like beryllium, form binary alloys with copper with liquidus points lower than that of pure copper, did not lower the liquidus point of copper-manganese-zinc alloys as did beryllium. That the copper-manganese-beryllium alloys in accordance with this invention exhibited narrow freezing ranges was also surprising and unexpected, as one commercial beryllium copper alloy containing 0.55–0.75% berylliu, 2.35–2.70% cobalt, balance copper, exhibits a far larger freezing range. Both the low liquidus temperature, consistently at or below 1517°F. and some at 1481°F., and the narrow freezing range, customarily less than 25°f., with some alloys showing isothermal solidification, are important and beneficial attributes of this copper-manganese-zinc-beryllium alloy system in providing superior casting behavior.

The following examples will further illustrate the invention. These data were obtained by melting and casting approximately 30-pound heats of the indicated compositions. Each heat was cast into (1) a 1 inch diameter × 4 inches tall chill cast cylinder from which alloy composition was determined; (2) a 2.5 × 2.5 × 4.5 inch very slow cooled casting into which a thermocouple was inserted while the casting was still fluid and a solidification curve traced; and (3) multiple 2 × 2 × 6 inches open back permanent mold castings. Liquidus and solidus temperatures were determined for each alloy from its solidification curve. Tensile specimens with 2 inch gage lengths were machined from one of the 2 × 2 × 6 inches permanent mold castings prepared in each heat. The following results were obtained:

TABLE I

| Example | Alloy Composition (Percent by Weight) Be | Mn | Zn | Cu[1] | Liquids (°F) | Solidus (°F) | 0.2% offset Yield Strength[2] (psi) | Ultimate Tensile Strength[2] (psi) | Elongation[2] (Percent in 2 Inches) |
|---|---|---|---|---|---|---|---|---|---|
| 1 | N.A.[3] | 13.90 | 24.30 | 61.80 | 1571 | 1548 | 22,300 | 41,500 | 10.0 |
| 2 | N.A. | 18.80 | 20.40 | 60.80 | 1544 | 1537 | 26,300 | 61,900 | 42.5 |
| 3 | N.A. | 22.20 | 17.10 | 60.70 | 1542 | 1535 | 24,300 | 48,000 | 27.0 |
| 4 | 0.06 | 14.80 | 24.00 | 61.14 | 1544 | 1544 | 24,600 | 59,500 | 31.0 |
| 5 | 0.06 | 18.90 | 20.10 | 60.94 | 1542 | 1542 | 24,600 | 60,000 | 41.0 |
| 6 | 0.05 | 23.00 | 17.30 | 59.65 | 1535 | 1535 | 24,300 | 61,600 | 49.5 |
| 7 | 0.21 | 14.60 | 17.10 | 68.09 | 1584 | 1472 | 21,200 | 51,400 | 45.0 |
| 8 | 0.21 | 11.30 | 26.80 | 61.69 | 1544 | 1526 | 25,100 | 59,900 | 19.5 |
| 9 | 0.23 | 22.00 | 16.70 | 61.07 | 1517 | 1499 | 28,100 | 67,300 | 37.0 |
| 10 | 0.20 | 26.40 | 13.20 | 60.20 | 1517 | 1517 | 29,300 | 59,700 | 17.5 |
| 11 | 0.21 | 18.70 | 20.90 | 60.19 | 1517 | 1517 | 26,300 | 63,100 | 32.0 |
| 12 | 0.19 | 20.90 | 22.10 | 56.81 | 1517 | 1499 | 29,100 | 63,900 | 20.0 |
| 13 | 0.22 | 22.20 | 24.70 | 52.88 | 1509 | 1509 | 42,300 | 66,600 | 3.0 |
| 14 | 0.45 | 17.00 | 18.70 | 63.85 | 1508 | 1468 | 26,800 | 64,700 | 26.5 |
| 15 | 0.45 | 18.50 | 20.50 | 60.55 | 1499 | 1479 | 29,000 | 63,900 | 18.5 |
| 16 | 0.50 | 22.80 | 16.90 | 59.80 | 1497 | 1479 | 30,000 | 68,500 | 22.0 |
| 17 | 0.43 | 20.20 | 22.40 | 56.97 | 1490 | 1490 | 32,000 | 64,800 | 14.0 |
| 18 | 0.76 | 14.80 | 16.70 | 67.74 | 1517 | 1490 | 27,500 | 63,500 | 20.5 |
| 19 | 0.70 | 12.20 | 22.60 | 64.50 | 1508 | 1490 | 26,600 | 61,500 | 19.5 |
| 20 | 0.67 | 17.00 | 18.90 | 63.43 | 1486 | 1476 | 30,000 | 66,700 | 19.5 |
| 21 | 0.66 | 20.80 | 15.90 | 62.64 | 1481 | 1476 | 30,700 | 71,900 | 16.0 |
| 22 | 0.70 | 25.60 | 13.10 | 60.60 | 1481 | 1467 | 28,600 | 68,500 | 17.0 |
| 23 | 0.76 | 18.40 | 20.70 | 60.14 | 1481 | 1472 | 29,900 | 64,200 | 11.0 |
| 24 | 0.75 | 22.60 | 16.80 | 59.85 | 1486 | 1472 | 31,100 | 67,200 | 14.0 |
| 25 | 0.78 | 15.20 | 24.60 | 59.42 | 1490 | 1482 | 29,600 | 62,800 | 16.0 |
| 26 | 0.74 | 19.30 | 23.25 | 56.71 | 1589 | 1490 | 34,000 | 65,100 | 9.0 |
| 27 | 0.70 | 22.60 | 20.13 | 56.57 | 1563 | 1490 | 34,900 | 64,300 | 12.0 |
| 28 | 0.93 | 15.00 | 15.60 | 68.47 | 1508 | 1486 | 29,600 | 65,100 | 10.0 |
| 29 | 0.94 | 18.90 | 20.25 | 59.91 | 1634 | 1490 | 30,100 | 58,900 | 10.0 |
| 30 | 1.20 | 18.40 | 20.50 | 59.90 | 1697 | 1476 | 28,000 | 59,400 | 17.0 |
| 31 | 2.03 | 18.00 | 20.00 | 59.97 | 1742 | 1504 | 32,200 | 44,900 | 3.0 |

[1]Cu taken by difference
[2]Permanent mold, as-cast properties
[3]None added, not analyzed These test results show the significant reduction in liquidus and solidus temperatures provided by the alloy compositions of the present invention, as well as the narrow freezing ranges and good as-cast tensile properties. The alloy composition of Example 23, with beryllium content within the 0.10–1.00% range, exhibits a more than 60°decrease in liquidus and solidus temperatures over that of the alloy compositions of Example 2 containing no beryllium, and yet still maintains a narrow freezing range. Similarly, the alloy compositions of Examples 9, 16, and 24 with beryllium contents within the 0.10–1.00% range, exhibit liquidus temperatures 18° to 49°F. lower than alloy compositions of Examples 3 and 6, with beryllium content less than 0.10%. Alloy compositions of Examples 11 and 15, with beryllium content within the range of 0.10–1.00%, have liquidus temperatures 180°–243°F. lower, and freezing ranges as much as 238°F. less than alloy compositions of Examples 30 and 31, with beryllium contents higher than 1.00%. The alloy composition of Example 9, with copper content within the range 50.0% + (10 × Be content) to 58.0% × (14 × Be content), shows a liquidus temperature 67°F. lower and a freezing range 94°F. lower than the alloy composition of Example 7, with copper content higher than that specified. Alloy compositions of Examples 24 and 25 with copper contents within the specified range show liquidus temperatures 73° to 103°F. lower, and freezing ranges as much as 71°F. narrower than the alloy compositions of Examples 26 and 27 with copper contents lower than the specified range. The alloy composition of Example 12 with copper content within the specified range exhibits significantly higher tensile ductility than the alloy composition of Example 13 with copper content below the specified range. The alloy composition of Example 8, with a manganese content below the specified range 12–36%, shows a relatively high liquidus temperature.

The invention alloy compositions of Examples 9–12, 14–25, and 28 all displayed excellent founding characteristics, ability to replicate mold surfaces and highly lustrous as-cast surfaces. The following additional examples further illustrate the invention. These data were obtained by melting and casting at 1660°F. alloy compositions indicated in the following table. For these trials, the following castings were prepared: (1) a 1 inch diameter by 4 inch tall chill cast cylinder from which alloy composition was determined; (2) a fluidity spiral casting; and (3) a double 1 × 1 × 6 inch keel leg casting with a single massive riser cast in green sand. Each fluidity spiral casting was prepared by pouring a molten alloy into a sprue feeding the outside terminus of a flat, horizontal, simple spiral cavity in a green sand mold. A second opening at the inside terminus of the spiral allowed air to escape the cavity as the metal filled the spiral mold. The spiral cavity was uniform in cross section, being essentially semicircular in shape and approximately 5/16 inch across the flat, top surface. Those results describing the appearance of as-cast surfaces were observations taken on the top surface (adjacent to the atmosphere during solidification) of the double leg keel casting after cooling to ambient temperatures. Those results describing the relative ability of the alloy compositions to replicate mold surfaces were based on the appearance of the top flat as-cast surfaces of the fluidity spiral castings approximately 3 inches from the pouring sprue and are shown at about 2 diameters magnification in FIGS. 1–6. Replication of mold detail was considered to improve as this top surface showed a greater degree of roughness or ability to penetrate the interstices between sand particles. The following results were obtained:

TABLE II

| Example | Alloy Composition (Percent by Weight) Be | Mn | Zn | Cu[1] | Appearance of Top Surface of Double Keel Leg Casting | Replication of Mold Detail | Replication Shown in Figure Number: |
|---|---|---|---|---|---|---|---|
| 32 | N.A.[2] | 20.80 | 20.60 | 58.60 | Black — heavily oxidized | Spiral cavity cross section not filled — no detail replicated | 1 |
| 33 | 0.05 | 21.00 | 20.40 | 58.55 | Lightly oxidized — little luster | Spiral cavity filled — little detail replicated | 2 |
| 34 | 0.20 | 20.80 | 20.60 | 58.40 | Highly lustrous — silvery | Spiral cavity filled — replication excellent | 3 |
| 35 | 0.69 | 16.60 | 17.20 | 65.51 | Highly lustrous — pale gold | Spiral cavity filled — replication excellent | 4 |
| 36 | 0.18 | 25.60 | 17.20 | 57.02 | Highly lustrous — silvery | Spiral cavity filled — replication excellent | 5 |
| 37 | 0.20 | 17.20 | 24.50 | 58.1 | Highly lustrous — pale gold | Spiral cavity filled — replication excellent | 6 |

[1]Cu taken by difference
[2]None added, not analyzed

Figure 2:
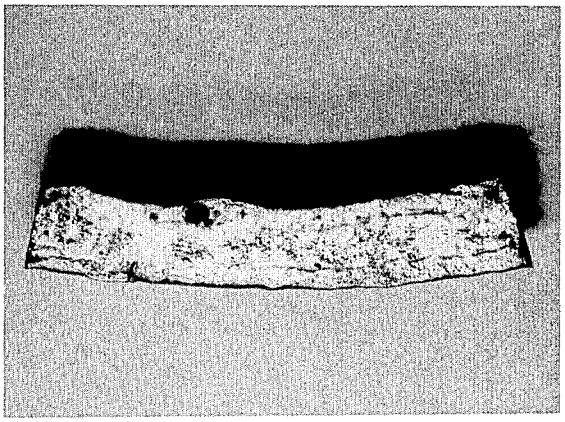
Figure 3:
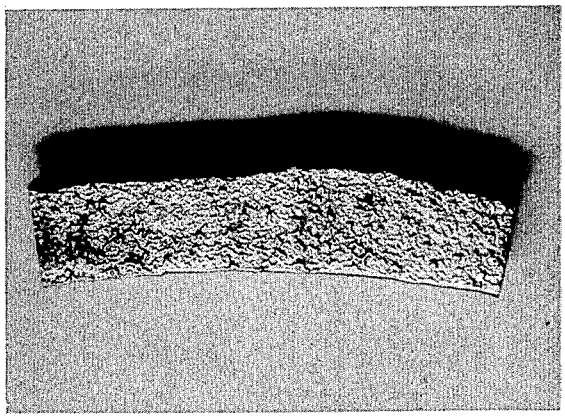
FIGS. 3 through 6 are photographic reproductions of castings within the scope of this invention, illustrating excellent mold replication.
Figure 4:
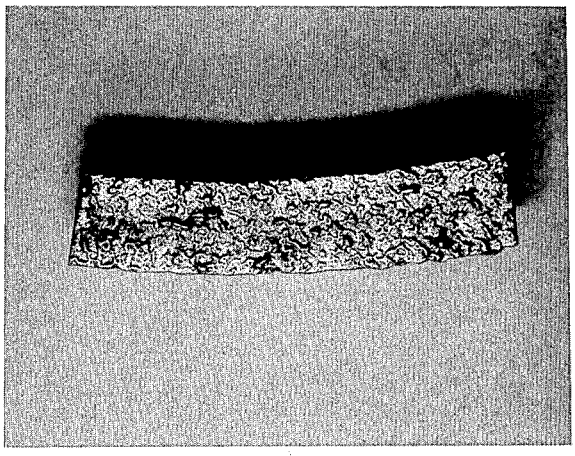
Figure 5:
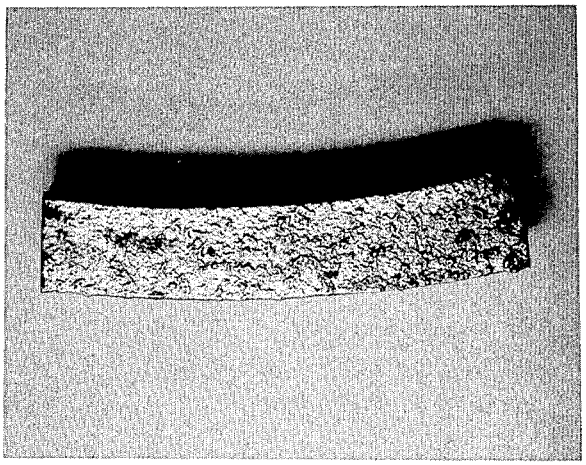
Figure 6:
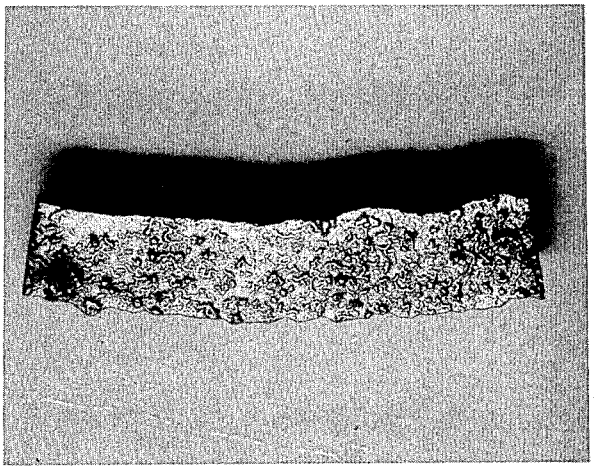

The test results of this table show considerable improvement in as-cast surface appearance and replication of mold surfaces provided by the alloy compositions of the present invention. The alloy compositions of Examples 34–37, with beryllium content within the range 0.10–1.00%, exhibit highly lustrous as-cast surfaces and remarkable ability to replicate mold surfaces (FIGS. 3–6), whereas, the alloy compositions of Examples 32 and 33, with beryllium content less than 0.10%, exhibit low luster as-cast surfaces and little ability to replicate mold surfaces (FIGS. 1 and 2).

That alloys within the scope of this invention exhibit increased strength and hardness when given deliberate heat treatments was unexpected. A second tensile bar was machined from the permanent mold castings of the alloy compositions of Examples 9, 11, 18, 23, and 25 and heat treated at 1400°F. for 1 hour and water quenched. These solution-treated bars were then aged at the temperatures shown in the following table for 3 hours and air cooled. Rockwell B scale hardness values were obtained on these heat-treated tensile bars and also on the as-cast tensile bars, whose test results are given in the first table. The following table will illustrate the hardening and strengthening effect of heat treatment on alloys within this invention:

TABLE III

| Example | Alloy Composition (Percent by Weight) Be | Mn | Zn | Cu[1] | Condition | 0.2% Offset Yield Strength (psi) | Ultimate Tensile Strength (psi) | Elongation (% in 2 in.) | Hardness ($R_b$) |
|---|---|---|---|---|---|---|---|---|---|
| 9 | 0.23 | 22.00 | 16.70 | 61.07 | As Cast[2] | 28,100 | 67,300 | 37.0 | 63.0 |
| | | | | | Aged at 800°F. | 68,900 | 95,800 | 8.5 | 94.0 |
| 11 | 0.21 | 18.70 | 20.90 | 60.19 | As Cast[2] | 26,300 | 63,100 | 32.0 | 58.2 |
| | | | | | Aged at 600°F. | 93,900 | 104,700 | 1.0 | 104.5 |
| 18 | 0.76 | 14.80 | 16.70 | 67.74 | As Cast[2] | 27,500 | 63,500 | 20.5 | 71.5 |
| | | | | | Aged at 800°F. | 48,200 | 73,200 | 19.0 | 84.5 |
| 23 | 0.76 | 18.40 | 20.70 | 60.14 | As Cast[2] | 29,900 | 64,200 | 11.0 | 65.5 |
| | | | | | Aged at 600°F. | 81,200 | 94,500 | 1.0 | 99.0 |
| 25 | 0.78 | 15.20 | 24.60 | 59.42 | As Cast[2] | 29,600 | 62,800 | 16.0 | 67.5 |
| | | | | | Aged at 700°F. | 95,300 | 103,800 | 0.5 | 96.0 |

[1]Copper taken by difference
[2]As cast yield strength, ultimate tensile strength, and elongation values are taken from the first table.

These results show that alloy compositions within this invention (including Examples 9, 11, 18, 23, and 25) are strengthened and hardened by the following heat treatment: solution treating at 1400°F. for 1 hour and cooling by water quenching, followed by a relatively low temperature ageing treatment at 600°–800°F. for 3 hours, and cooling in still air. Yield strength values are increased by as much as 250%, and ultimate tensile strength values by as much as 65%. Tensile ductility is reduced. Ageing at 600°–800°F. also increases the strength and hardness of alloys without solution treating, and material solution treated followed by slow cooling, e.g., in still air.

The copper-manganese-zinc-beryllium alloys of this invention are prepared by charging copper and manganese and melting, keeping the temperature as low as possible to minimize manganese oxide formation on the top of the bath. Zinc is then added, preferably below 1950°F. to minimize zinc fuming. Beryllium, conveniently in the form of a copper-4 weight percent beryllium master alloy, is added at a sufficiently high temperature to avoid freezing the bath, e.g., at 1850°F. The melt is then stirred, skimmed, and poured.

If lead is added, it is substituted for a like amount of copper in the alloy's composition. Lead is conveniently added to the bath just prior to or just after the beryllium addition.

Crucibles or vessels fabricated of any suitable refractory material, examples being magnesia or clay graphite, can be used to melt and handle these alloys.

The alloys of this invention can be cast as sand mold, permanent mold, investment mold, and pressure die castings, due to their low melting points and excellent founding characteristics. The high degree of mold replication and lustrous as-cast surfaces characteristic of alloys in this invention should allow castings to be put into use with little or no surface finishing. Operations such as grinding, brushing, sanding, buffing, polishing, and pickling may be eliminated, or certainly reduced, when these alloys, rather than those which form unattractive oxide skins during casting, are used. These attributes of the invention make these alloys well suited for decorative applications such as plumbing accessories and fixtures and architectural hardware such as door knobs and window cranks, and as cores in plastic injection mold tooling. That these alloys can be heat treated to high strength and hardness should allow their use as mechanical components in equipment and machinery.

Within the parameters of the alloy system according to this invention, certain properties may be optimized. Those properties are the liquidus point of the alloy, mechanical properties, castability, replication of detail, the ability to withstand dealloying, use of the material as a brazing material, the ability of the alloy to be wrought, and heat treatable characteristics.

Optimizing the Liquidus Point

Figure 7:
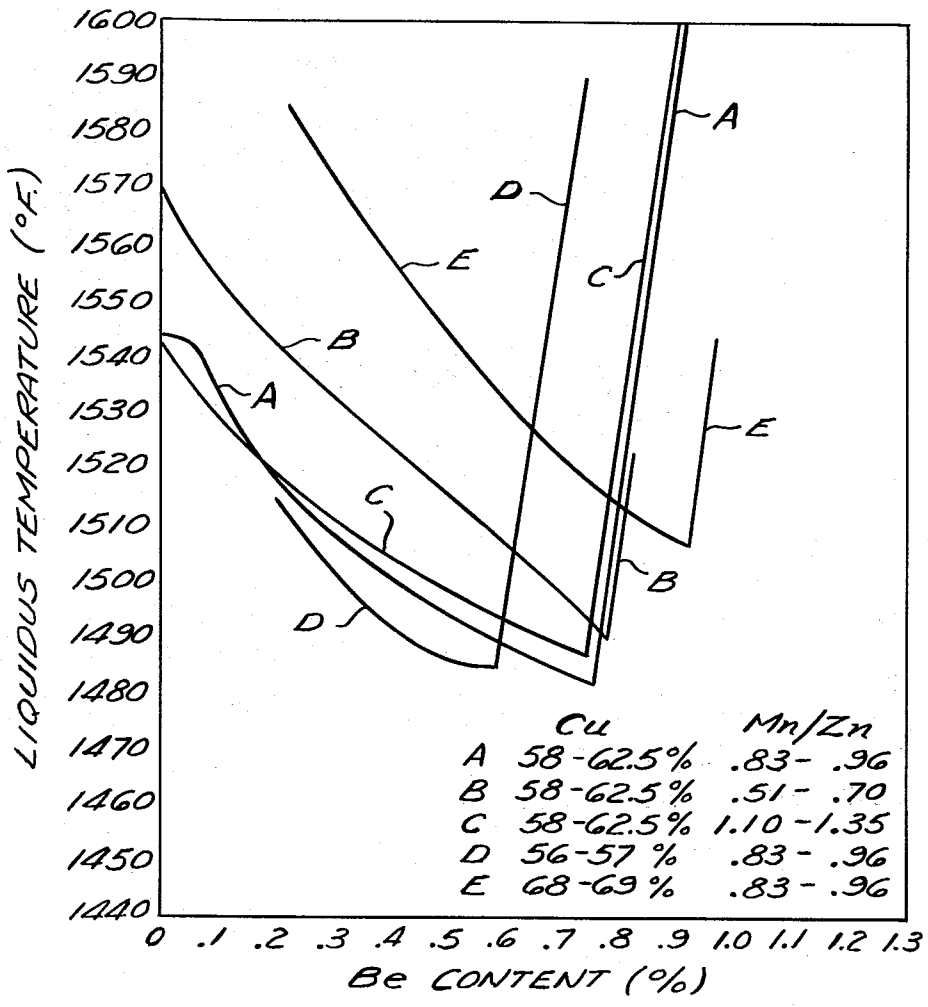
FIG. 7 is a graph showing the effect of beryllium content on the liquidus points of alloys containing various amounts of copper and having various manganese-to-zinc ratios.

Increasing beryllium initially lowers the liquidus points of Cu-Mn-Zn-Be alloys, but, past a critical level, dependent upon copper content, liquidus points are sharply increased by further beryllium additions, as may be seen in FIG. 7. Higher copper alloys require higher beryllium contents for minimum liquidus points. For example, at 68 to 69% copper, 0.9 to 1.0% beryllium is necessary to provide the minimum liquidus point. At 58 to 62.5% copper, 0.7 to 0.8% beryllium is required, and at 56 to 57% copper, only 0.5 to 0.6% beryllium is required. The relationship of beryllium content to liquidus points or to the minimum liquidus temperature is little affected by varying the manganese-to-zinc ratio between 0.51 and 1.35, as may be seen by comparing curves A, B, and C in FIG. 7. However, optimum liquidus points are achieved when the manganese-to-zinc ratio is between 0.5 and 3.8.

Freezing ranges are generally small for beryllium contents up to and including that level required for minimum liquidus, but are large past this point. Increasing beryllium lowers the solidus point up to this critical value, and maintains the solidus at a fairly constant low value beyond this point. Because the liquidus rises steeply past the critical level, freezing ranges increase greatly. Low liquidus point compositions generally show small freezing ranges.

Figure 8:
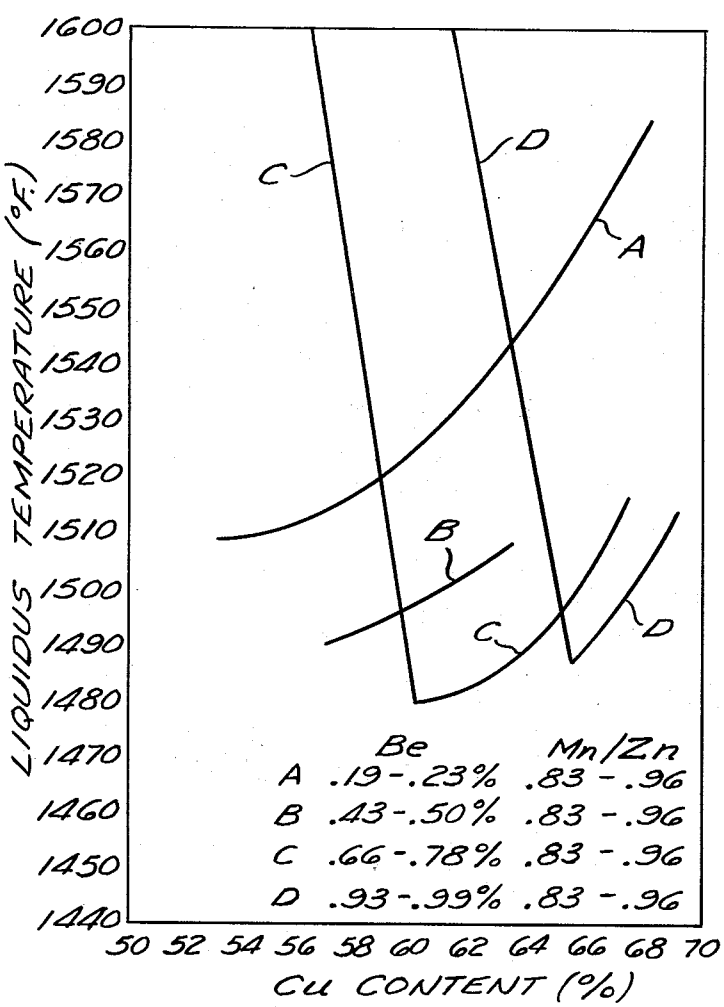
FIG. 8 is a graph showing the effect of copper content on the liquidus points of alloys containing various amounts of beryllium, with manganese-to-zinc ratios equal to 0.83 to 0.96.

Referring now to FIG. 8, it may be seen that at 0.75% beryllium, increasing the copper content to 60% decreases the liquidus point, and increasing the copper content further raises the liquidus point. Therefore, as copper is increased, the liquidus point is lowered greatly until the critical copper content for minimum liquidus is reached. Past this critical level, increasing copper raises the liquidus point, although less steeply. The critical copper level increases as beryllium increases. Freezing ranges are generally small for copper contents at or higher than the critical level. Thus, minimum liquidus compositions also have narrow freezing ranges.

Figure 9:
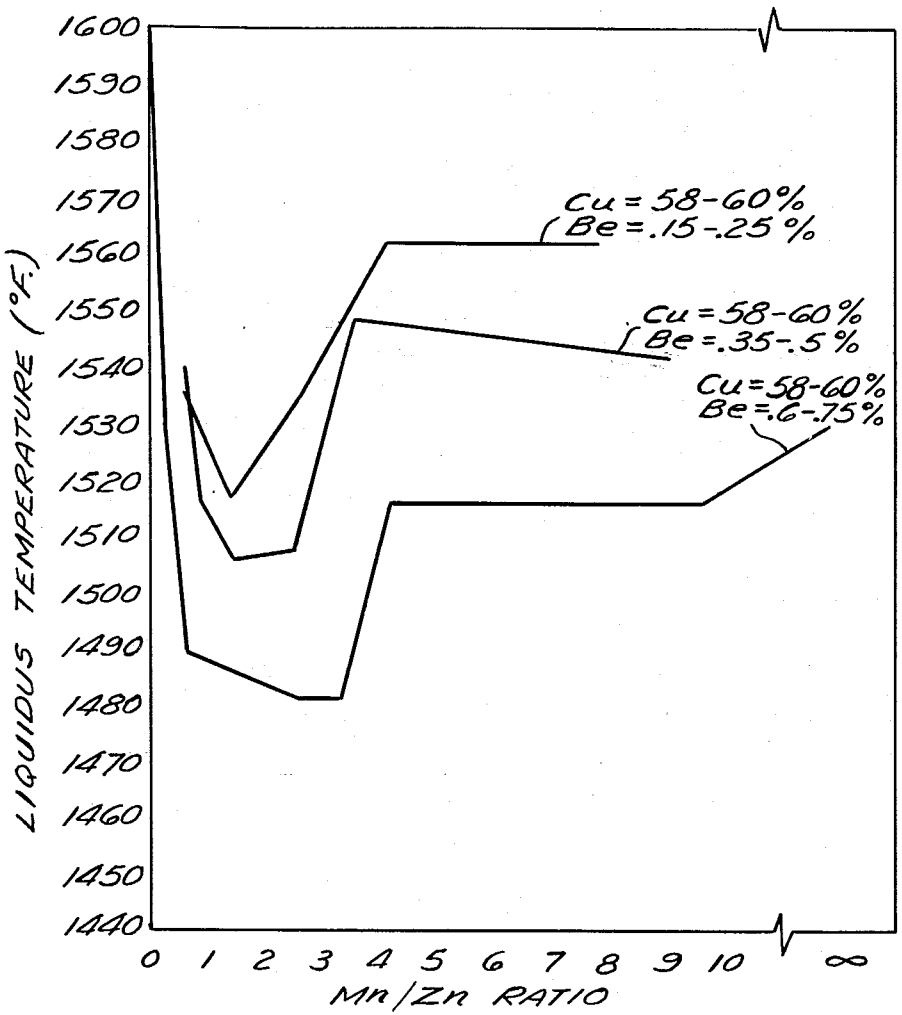
FIG. 9 is a graph showing the effect of manganese-to-zinc ratios on liquidus points of alloys containing various amounts of beryllium and copper.

Referring now to FIG. 9, manganese-to-zinc ratios between 0.5 and 3.8 optimize the minimize liquidus point and, as may be noted in FIG. 9, very low liquidus points are achieved with the manganese-to-zinc ratio within the aforementioned range and with the beryllium content between 0.6 and .75%. Copper contents should be between about 58 and 62.5%.

Figure 10:
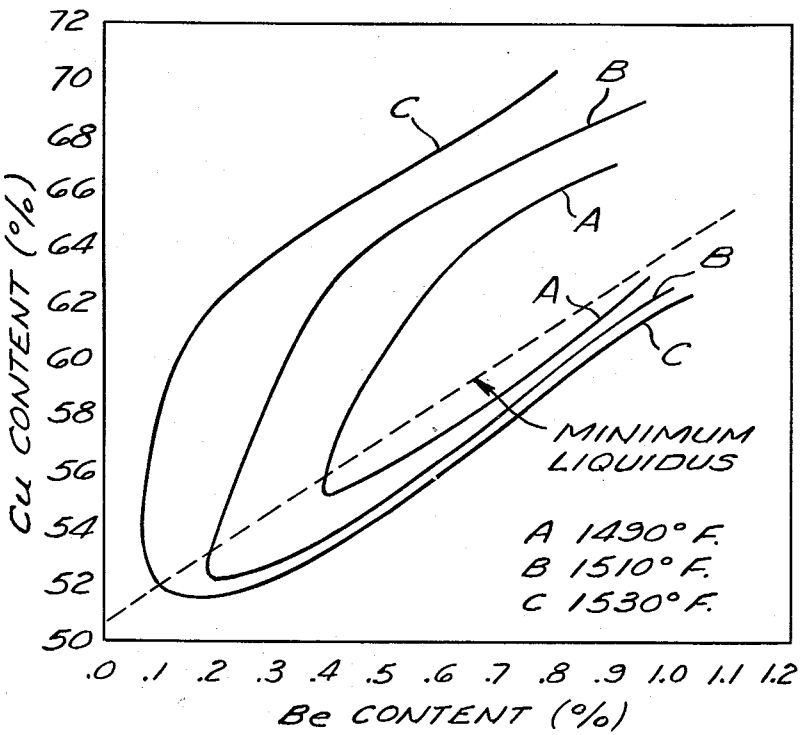
FIG. 10 is a graph showing the combined effect of copper and beryllium content on the liquidus points of alloys having manganese-to-zinc ratios greater than 0.83.

Low liquidus alloys can also be found outside the above-stated range at higher beryllium and copper combinations (for example, at 1.0% beryllium and 64% copper) and at lower beryllium and copper combinations (for example, at 0.4% beryllium and 56% copper). Alloy compositions with attractively low liquidus points will therefore fall near the line from 0.1% beryllium - 52% copper and 1.0% beryllium - 66% copper (the dotted line in FIG. 10). Alloys at high beryllium-copper combinations have higher pot costs and may be of less commercial interest. Alloys with lower beryllium-copper combinations have lower pot costs but slightly higher liquidus points.

Whereas alloys on or above the minimum liquidus line have narrow freezing ranges, alloys below the line have large freezing ranges and very high liquidus points.

Mechanical Properties

Alloys in the Cu-Mn-Zn-Be system are hardened and strengthened by increasing beryllium and total manganese plus zinc content. As hardness and strengths are increased, however, ductility generally decreases. For purposes of commercial acceptability, ductility values over about 10 percent elongation have been considered acceptable. The alloy composition giving the optimum mechanical properties is therefore defined as providing the highest strength and hardness values and at least 10 percent elongation.

Figure 12:
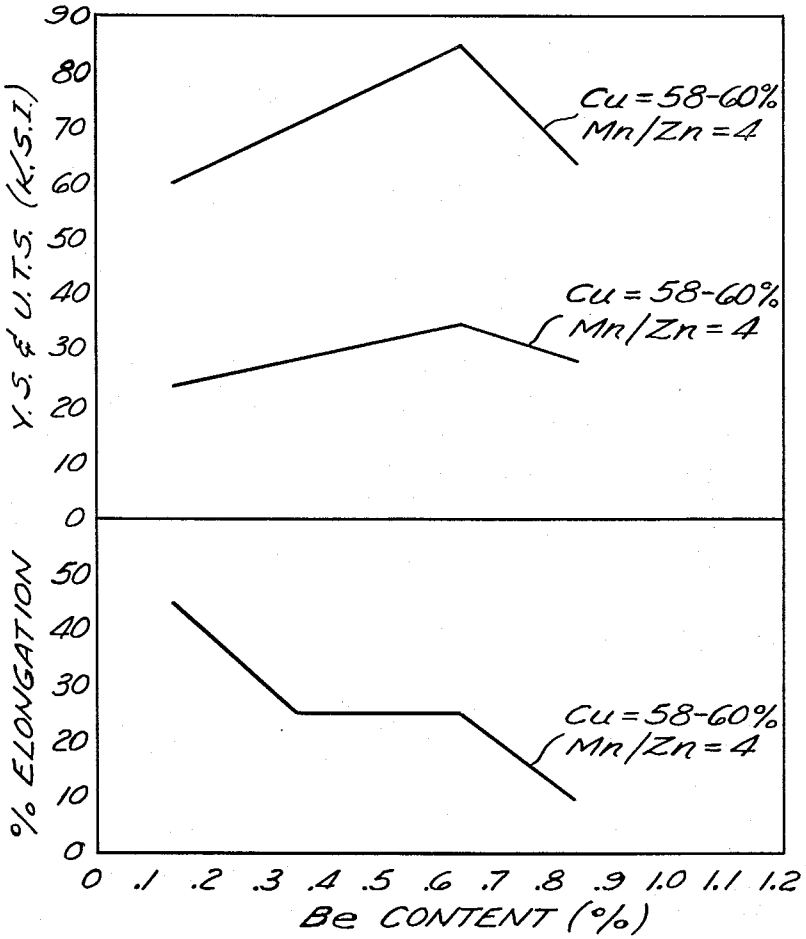
FIG. 12 is a graph showing the effects of the beryllium content on mechanical properties.
Figure 11:
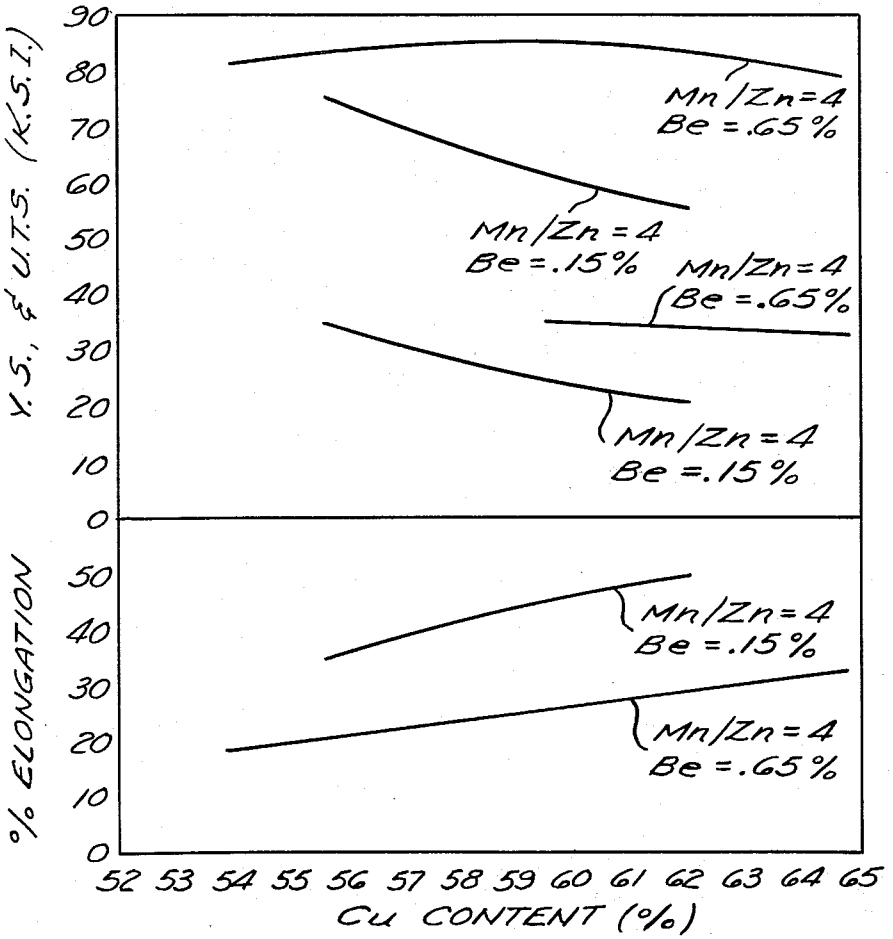
FIG. 11 is a graph showing the effects of the copper content on mechanical properties.

Although beryllium lowers ductility, at least 10 percent elongation is maintained up to 1.0% beryllium for alloys containing 58.0 to 62.5% copper. Any beryllium level in this range would provide sufficient ductility. In this range, hardness and yield strengths increase gradually. Ultimate strength, however, peaks at about 0.5% beryllium and is near maximum between 0.2 and 0.8%. The optimum beryllium range is between 0.6 and 0.75% (see FIG. 12). Very good mechanical properties can be obtained at low beryllium contents between about 0.1 to 0.125% if the copper content is lowered down to about 54%.

Increasing the copper, and therefore lowering the total manganese plus zinc, softens the alloy. At least about 57% copper is necessary for 10 percent elongation for alloys containing 0.66 to 0.78% beryllium, and at least 54% copper is necessary for alloys containing 0.19 to 0.23% beryllium. For manufacturing purposes, it is better to maintain copper at 59 and 56% at the high and low beryllium levels, respectively, because if the copper content is low by only 1.0 or 2.0%, ductility is seriously lowered. Optimum copper content for an alloy containing 0.5% beryllium is 58.0%. Alloys containing 59.0% copper - 0.7% beryllium, and 56% copper - 0.2% beryllium have equivalent mechanical properties.

Figure 13:
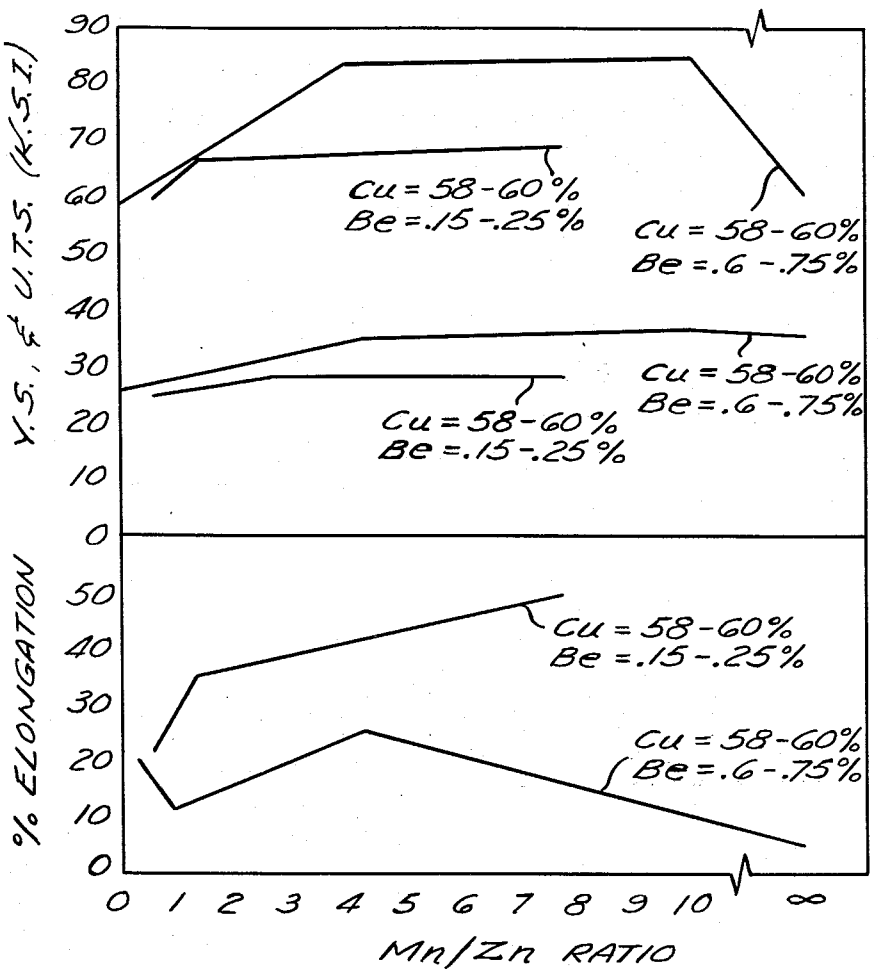
FIG. 13 is a graph showing the effect of the manganese-to-zinc ratio on mechanical properties.

As may be seen in FIG. 13, the manganese-to-zinc ratio has a surprising effect on mechanical properties. Manganese-to-zinc ratios of between 3.5 and 10 result in an alloy having an ultimate tensile strength of at least 80 ksi, yield strength of at least 35 ksi, and at least 10 percent elongation.

Castability

For the entire range of alloys encompassed by this invention, the castability is very good as long as the beryllium content is at least 0.1%. The foundry characteristics are quite good for alloys containing 0.1% beryllium over the very broad manganese-to-zinc ratios for various copper compositions.

Replication of Detail

An important application of the alloy according to this invention is tooling for plastic molding and, more particularly, the mold into which plastic is injected. It is often desirable to provide surface detail on the plastic part, such as, for example, a simulated wood grain on the surface of the plastic. Since the mold cavity must have detail in its surface, the metal in turn would have to pick up this detail from the ceramic mold in which it is cast. The ability of the metal to be cast into the ceramic mold and lie against the surface to intimately pick up all of its detail is vital in this application. As long as the beryllium content is kept above 0.25%, replication of detail is very good. The zinc-rich alloys tend to replicate mold wall detail better than the manganese-rich alloys, although as long as the beryllium content is kept at about 0.5% or above, the ability of the manganese-rich alloys to replicate mold wall detail is excellent.

Surface and Interior Characteristics

If an alloy according to this invention is to be used as a cast product, it is important that the cast product be surface-finished with a minimum amount of effort. An outstanding characteristic of the alloy is that if it is cast in a permanent mold or into metal molds, or even into sand, the resulting casting is bright, clean, and lustrous. The surface and the interior metal are golden in zinc-rich alloys, and they tend to be white in the manganese-rich area. Alloys with manganese-to-zinc ratios of 4.0 or greater do not have as lustrous a surface as alloys with lower manganese-to-zinc ratios. Therefore, for applications which require either a lustrous as-cast surface or the ability to be polished to a lustrous surface, the manganese-to-zinc ratio should be kept below 4.0.

Resistance to Dealloying

In applications such as plumbing fixtures, where die casting of the alloy might be used, the ability of the alloy to withstand dealloying, i.e., the selective removal of manganese and zinc from the matrix, is an important consideration. The manganese-rich alloys with, for example, a manganese-to-zinc ratio of about 1.2 and a low beryllium content of about 0.25% have superior dealloying resistance compared to alloys with higher or lower manganese-to-zinc ratios and higher beryllium contents. Since beryllium lowers the resistance to dealloying, the beryllium should be as low as possible but compatible with the other characteristics of the casting alloy for the particular application in question.

The following examples will further illustrate the resistance to dealloying: These data were obtained by melting and casting 30 pound heats of the indicated compositions. A single 1 × 1 × 1/4 inch wafer was cut from the first pig cast in each heat and finished to 400 grit by abrasive belt grinding. A ⅛ inch hole was drilled in the center of each wafer in order to suspend it in the corrosion bath. All 19 alloys were suspended horizontally in the same 5.88 liter bath for 6 hours at 75° ± 3° C. The bath contained 10 gm/l $CuCl_2$ and had a volume of 16 ml/$cm_2$ of specimen surface. Nylon cord was used to suspend the specimens. The following results were obtained:

TABLE IV

Effect of Beryllium Content on Dealloying Corrosion

| Alloy No. | Be (%) | Mn+Zn Content (%) | Mn/Zn Ratio | Depth of Attack (0.001") |
|---|---|---|---|---|
| 00158 | NA[1] | 38.2 | 0.57 | 17.5 |
| 00125 | 0.22 | 39.3 | 0.58 | 20.0 |
| 00126 | 0.78 | 39.8 | 0.62 | 18.0 |
| 00159 | NA | 39.2 | 0.92 | 5.5 |
| 00162 | 0.06 | 39.0 | 0.94 | 13.5 |
| 00129 | 0.21 | 39.6 | 0.89 | 20.0 |
| 00166 | 0.45 | 39.0 | 0.90 | 20.0 |
| 00130 | 0.76 | 39.1 | 0.89 | 17.0 |
| 00157 | NA | 39.3 | 1.30 | 6.5 |
| 00123 | 0.23 | 38.7 | 1.32 | 8.5 |
| 00124 | 0.75 | 39.4 | 1.35 | 16.5 |
| 00121 | 0.21 | 31.7 | 0.85 | 10.0 |
| 00122 | 0.67 | 31.5 | 0.89 | 16.5 |
| 00177 | Bronwite[2] | | | <16.0[3] |

[1]N.A. — none added, not analyzed
[2]20% Mn, 20% Zn, 1.0% Al, balance Cu
[3]Original surface gone, attack greater than remaining layer thickness The appearance of the alloy wafers changed in two ways during exposure (1) a very loose, thick layer of copper was deposited on the surface of the wafers and (2) dealloying occurred below the original surfaces. The loose copper layer was probably deposited from the copper in the solution during dealloying. The thickness of the layers did not seem to be related to the amount of dealloying, although it was expected that as the amount of zinc and manganese that oxidized was increased, the thickness of this layer would be increased. However, much of this loose copper was found at the bottom of the container used for the corrosion test, indicating that perhaps the heaviest deposits had fallen off. In any event, the presence of some loose copper shows dealloying is occurring, but its thickness is not a reliable measurement of the severity of the attack.

Dealloying was not apparent after the loose copper was removed. Most of the original surfaces were intact, in fact still showing grinding marks, although three wafers (00157, 00159, and 00123) showed adherent copper deposits and two wafers (00163 and 00177) had irregular surfaces, indicating that the original surfaces were gone. Dealloying was easily seen in cross section under the microscope as a porous copper layer with a gray corrosion product throughout.

Brazing Materials

It has been found that for brazing, an alloy containing 18.5% manganese, 21.2% zinc, and 0.32% beryllium is a better brazing material than alloys containing 24% manganese, 16.3% zinc, and 0.25% beryllium or an alloy containing 15% manganese, 24.7% zinc, and 0.29% beryllium. All three of these alloys have about the same total manganese and zinc content, and all have about the same copper content. However, the manganese-rich and zinc-rich alloys do not perform as well as alloys containing about the same manganese and zinc. Acceptable brazing alloys contain from about 18 to 19% manganese, 20.5 to 21.5% zinc, and from 0.2 to 0.35% beryllium.

What is claimed is:

1. A heat-treated copper-base alloy article consisting essentially of the following constituents in the proportions and ratios specified:

| | Percent by weight |
|---|---|
| Manganese | 12 to 36 |
| Zinc | 4 to 28 |
| Beryllium | 0.10 to 1.00 |
| Copper | 50.0 + (10 × Be content)<br>58.0 + (14 × Be content), |

and such that the manganese-to-zinc ratio is between 0.4 and 10, said alloy article having excellent founding characteristics, ability to replicate mold surfaces with great detail, and improved mechanical properties.

2. A copper-base alloy article according to claim 1, additionally characterized by a low liquidus point of between about 1480° and 1600° F. wherein said manganese-to-zinc ratio is between 0.5 and 3.8, said beryllium is between 0.6 and 0.75%, and said copper is between 58 and 62.5%.

3. A copper-base alloy article according to claim 1, further characterized by a low liquidus point of between about 1480° and 1600° F., wherein the manganese-to-zinc ratio is between 0.5 and 3.8, the beryllium is between 0.1 and 0.7%, and the copper is between 52 and 60%.

4. A copper-base alloy article according to claim 1, wherein said manganese-to-zinc ratio is between 3.5 and 10, the beryllium is between 0.6 and 0.75%, and the copper is between 58 and 62.5%, said alloy having an ultimate tensile strength of at least 80 ksi, a yield strength of at least 35 ksi, and at least 10 percent elongation.

5. A copper-base alloy article according to claim 1, wherein said beryllium is between 0.1 and 0.125% and said copper is about 54%.

6. A copper-base alloy article according to claim 1, wherein the beryllium content is between 0.25 and 1.0%, and wherein the manganese-to-zinc ratio is less than 1.

7. A copper-base alloy article according to claim 1, wherein the beryllium content is 0.5% and above, and wherein the manganese-to-zinc ratio is greater than 1.

8. A copper-base alloy article according to claim 1, further characterized by a lustrous surface wherein the manganese-to-zinc ratio is less than 4.

9. A copper-base alloy article according to claim 1, further characterized by optimum ability to withstand dealloying, wherein the manganese-to-zinc ratio is about 1.2, and the beryllium content is about 0.25%.

10. A copper-base alloy article according to claim 1, characterized by its ability to serve as a brazing material, wherein the manganese-to-zinc ratio is about 1, the copper content is about 60%, and the beryllium is about 0.32%.

11. A copper-base alloy article according to claim 1, further characterized by its ability to serve as a brazing material, wherein the manganese is from 18 to 19%, the zinc is from 20.5 to 21.5% and the beryllium is from 0.2 to 0.35%.

12. A copper-base alloy article according to claim 1, further characterized by its ability to be wrought, wherein the manganese-to-zinc ratio is from 0.6 to 0.8, the beryllium is not greater than 0.4%, and the copper content is not less than 60%.

13. A method of heat treating a copper-base alloy article comprising the steps of providing a copper-base alloy consisting essentially of the following constituents in the proportions specified:

| | Percent by Weight |
|---|---|
| Manganese | 12 to 36 |
| Zinc | 4 to 28 |
| Beryllium | 0.10 to 1.00 |
| Copper | 50.0 + (10 × Be content)<br>58.0 + (14 × Be content), |

solution heat treating said alloy at a temperature of about 1400° F. for about one hour, quenching said alloy, ageing said alloy at a temperature between about 600° and 800° F. selected to yield elongation of at least 10% and for about three hours, and cooling the alloy in still air.

14. A method of heat treating a copper-base alloy article comprising the steps of providing a copper-base alloy consisting essentially of the following constituents in the proportions specified:

| | Percent by Weight |
|---|---|
| Manganese | 12 to 36 |
| Zinc | 4 to 28 |
| Beryllium | 0.10 to 1.00 |
| Copper | 52 to 72, |

solution heat treating said alloy at a temperature of about 1400° F. for about one hour, quenching said alloy, aging said alloy at a temperature between about 600° and 800° F. selected to yield elongation of at least 10% and for about 3 hours, and cooling the alloy in still air.

* * * * *

UNITED STATES PATENT OFFICE
CERTIFICATE OF CORRECTION

PATENT NO. : 3,972,712
DATED : August 3, 1976
INVENTOR(S) : Patrick D. Renschen

It is certified that error appears in the above-identified patent and that said Letters Patent are hereby corrected as shown below:

Column 5, line 3, "berylliu" should read -- beryllium --; line 8, "25°f." should read 25°F. --; line 65, "60°" should read -- 60°F. --.

Column 12, line 23, "alloys" should read -- alloy wafers --; line 47, "$<16.0^{(3)}$" should read -- $>16.0^{(3)}$ --.

Column 14, line 5, after "claim 1", delete the comma.

Signed and Sealed this
First Day of February 1977

[SEAL]

*Attest:*

RUTH C. MASON
*Attesting Officer*

C. MARSHALL DANN
*Commissioner of Patents and Trademarks*